US006007590A

United States Patent [19]

Sanders, Jr.

[11] Patent Number: 6,007,590

[45] **Date of Patent: *Dec. 28, 1999**

[54] METHOD OF MAKING A FORAMINOUS ABRASIVE ARTICLE

[75] Inventor: Rufus C. Sanders, Jr., Burnsville, Minn.

[73] Assignee: 3M Innovative Properties Company, Saint Paul, Minn.

[ * ] Notice: This patent is subject to a terminal disclaimer.

[21] Appl. No.: 08/930,097

[22] PCT Filed: May 3, 1996

[86] PCT No.: PCT/US96/06279

§ 371 Date: Nov. 12, 1997

§ 102(e) Date: Nov. 12, 1997

[87] PCT Pub. No.: WO97/42004

PCT Pub. Date: Nov. 13, 1997

[51] Int. Cl.[6] ..... B24D 3/28

[52] U.S. Cl. ..... 51/295; 51/309; 51/294; 51/298; 51/299; 51/296

[58] Field of Search ..... 51/294, 295, 307, 51/309, 299, 303, 298, 296; 427/243, 244, 246

[56] References Cited

U.S. PATENT DOCUMENTS

| | | |
|---|---|---|
| 211,576 | 1/1879 | Arndt . |
| 412,321 | 10/1889 | Burkman . |
| 894,753 | 7/1908 | Smith . |
| 1,854,071 | 4/1932 | Schacht . |
| 2,307,698 | 1/1943 | Melton et al. . |
| 2,324,018 | 7/1943 | Petersen . |
| 2,596,565 | 5/1952 | Kautenberg . |
| 2,619,330 | 11/1952 | Willems . |
| 2,639,901 | 5/1953 | Teale . |
| 2,717,703 | 9/1955 | Kull et al. . |
| 2,958,593 | 11/1960 | Hoover et al. . |
| 3,175,331 | 3/1965 | Klein . |
| 3,401,491 | 9/1968 | Schnabel et al. . |
| 3,607,159 | 9/1971 | Haywood ..... 51/298 |
| 3,630,800 | 12/1971 | Nash et al. . |
| 3,701,703 | 10/1972 | Zimmer, Jr. et al. . |
| 3,773,480 | 11/1973 | Hall et al. . |
| 3,777,981 | 12/1973 | Probst et al. . |
| 3,875,892 | 4/1975 | Gregg et al. . |
| 3,918,220 | 11/1975 | Jury et al. . |
| 4,086,872 | 5/1978 | Pan . |
| 4,088,093 | 5/1978 | Pan . |
| 4,092,440 | 5/1978 | Wöhr et al. . |
| 4,094,760 | 6/1978 | Smith et al. . |
| 4,107,792 | 8/1978 | Dürr . |
| 4,111,668 | 9/1978 | Walker et al. . |
| 4,227,350 | 10/1980 | Fitzer . |
| 4,240,807 | 12/1980 | Kronzer . |
| 4,342,345 | 8/1982 | Nadin et al. . |
| 4,343,828 | 8/1982 | Smead et al. . |
| 4,384,787 | 5/1983 | Ito et al. . |
| 4,427,712 | 1/1984 | Pan . |
| 4,554,765 | 11/1985 | Grimes et al. . |
| 4,569,861 | 2/1986 | Smith et al. . |
| 4,613,345 | 9/1986 | Thicke et al. . |
| 4,652,274 | 3/1987 | Boettcher et al. . |
| 4,788,933 | 12/1988 | Buschor . |

(List continued on next page.)

FOREIGN PATENT DOCUMENTS

| | | |
|---|---|---|
| 0 010 408 B1 | 2/1983 | European Pat. Off. . |
| 0 192 047 A2 | 8/1986 | European Pat. Off. . |
| 0 562 919 A1 | 9/1993 | European Pat. Off. . |
| 2103043 | 4/1922 | France . |
| 2409095 | 6/1979 | France . |
| 2447230 | 8/1980 | France . |
| 2722083 | 11/1978 | Germany . |
| 52-118689 | 10/1977 | Japan . |
| 55-12775 | 8/1980 | Japan . |
| 61-025776 | 2/1986 | Japan . |
| 2311273 | 12/1990 | Japan . |
| 5220670 | 8/1993 | Japan . |
| 396266 | 8/1973 | U.S.S.R. . |
| (11)1093530 | 5/1984 | U.S.S.R. . |
| (11)194665 | 11/1985 | U.S.S.R. . |
| 9(11)1553368 | 3/1990 | U.S.S.R. . |
| 939361 | 10/1963 | United Kingdom . |
| 1 328 292 | 8/1973 | United Kingdom . |
| 2 070 637 | 9/1981 | United Kingdom . |
| 2224489 | 5/1990 | United Kingdom . |
| WO 96/28256 | 9/1996 | WIPO . |
| WO 97/42003 | 11/1997 | WIPO . |

OTHER PUBLICATIONS

Spare Parts List PG 1–E Manual Enamel Gun, Gema Volstatic Industrial Powder Systems, Mar. 1992.

Gema Brochure: "Powder Delivery Control Unit" (no date).

Brochure: "American Industrial Corporation ", 4730 Industrial Parkway, Indianapolis, IN 46226 (no date).

Operating Instructions and Spare Parts List, "MPS 1–L Manual Powder System with the PG 1 Powder Gun", Gema Volstatic Industrial Powder Systems, Dec. 1990.

Kirk–Othmer "*Encyclopedia of Chemical Technology*", 3rd Edition, John Wiley & Sons 1981, New York, vol. 17, pp. 384–399 (no month).

*Primary Examiner*—Michael Marcheschi
*Attorney, Agent, or Firm*—Daniel R. Pastirik; Scott A. Bardell

[57] ABSTRACT

A method for manufacturing a foraminous abrasive article whereby abrasive particles are concentrated in an external surface region of a foraminous substrate. The method includes the steps of: providing a foamable, hardenable, liquid resin composition and a foraminous substrate having an external surface; foaming the resin composition effective to disperse a plurality of gas bubbles throughout the resin composition; applying the foamed resin composition to the external surface of the substrate to form a foam coating layer having an upper surface; applying a plurality of abrasive particles to the upper surface of the foam coating layer; heating the foamed coating layer effective to eliminate the gas bubbles from the foamed coating layer; and hardening the resin composition to attach the abrasive particles to the substrate. The invention also concerns the foraminous abrasive article products of this method.

18 Claims, No Drawings

U.S. PATENT DOCUMENTS 4,826,703 5/1989 Kisler .
4,835,004 5/1989 Kawanishi .
4,856,931 8/1989 Bollag .
4,883,363 11/1989 Pillon et al. .
4,903,440 2/1990 Larson et al. .
4,966,609 10/1990 Callinan et al. .
4,969,975 11/1990 Biggs et al. .
4,991,362 2/1991 Heyer et al. .
5,025,596 6/1991 Heyer et al. .
5,082,720 1/1992 Hayes .
5,152,809 10/1992 Mattesky ..... 51/295
5,183,479 2/1993 Grimes .
5,222,663 6/1993 Noakes et al. .
5,236,472 8/1993 Kirk et al. .
5,238,709 8/1993 Wilkie .
5,242,718 9/1993 Gillette et al. .
5,242,749 9/1993 Bayly et al. .
5,250,326 10/1993 Drummond et al. .
5,279,863 1/1994 Escallon .
5,298,277 3/1994 Hirose .
5,307,593 5/1994 Lucker et al. .
5,320,879 6/1994 Bullock .
5,332,154 7/1994 Maier et al. .
5,340,616 8/1994 Amano et al. .
5,344,688 9/1994 Peterson et al. .
5,360,462 11/1994 Harmer et al. .
5,363,604 11/1994 Heyer .
5,366,523 11/1994 Rowenhorst et al. .
5,368,237 11/1994 Fulkerson .
5,368,618 11/1994 Masmar et al. .
5,374,456 12/1994 Matossian et al. .
5,378,252 1/1995 Follensbee .
5,409,162 4/1995 Sickles .
5,415,717 5/1995 Perneborn .
5,429,545 7/1995 Meyer .
5,431,963 7/1995 Rzad et al. .
5,464,667 11/1995 Köhler et al. .
5,482,756 1/1996 Berger et al. .
5,573,844 11/1996 Donovan et al. .
5,580,647 12/1996 Larson et al. .
5,591,239 1/1997 Larson et al. ..... 51/294
5,609,513 3/1997 Stark .
5,681,361 10/1997 Sanders, Jr. .
5,685,935 11/1997 Heyer et al. ..... 51/296
5,849,051 12/1998 Beardsley et al. ..... 51/295
5,863,305 1/1999 Beardsley et al. ..... 51/294

METHOD OF MAKING A FORAMINOUS ABRASIVE ARTICLE

The invention is generally related to a method of making a foraminous abrasive article with use of a labile foamed binder as a transitory abrasive particle barrier by which abrasive particles are preferentially bonded to external surface regions of a foraminous substrate.

BACKGROUND OF THE INVENTION

Foraminous abrasive articles have been made, for example, as nonwoven abrasive articles constituted of a network of synthetic fibers or filaments which provide surfaces upon which abrasive particles are adhesively attached.

Nonwoven abrasive articles, in particular, are useful in various converted forms, such as wheels, sheets, discs, flap brushes, and the like. In these converted forms, the resulting nonwoven abrasive articles are useful to clean, condition, and/or decorate the surfaces such materials as metal, wood, plastics, glass, ceramics, composites, and the like. A particularly important use for such nonwoven abrasive articles is to scuff automotive body finishes prior to the application of further coatings.

Conventional nonwoven abrasive articles generally involve a mat of fibers which have on at least a portion of their surface an abrasive coating comprising abrasive particles and a binder. As known, the fibers can be formed from various synthetic polymers, including polyamides, polyesters, polypropylene, polyethylene, and various copolymers thereof. Also, naturally occurring fibers such as cotton, wool, bast fibers, and various animal hairs may also be suitable. Suitable abrasive particles can be formed of flint, garnet, aluminum oxide, diamond, silicon carbide, and the like. Binders commonly comprise cured versions of hide glue or varnish, or one or more resins such as phenolic, urea-formaldehyde, melamine-formaldehyde, urethane, epoxy, and acrylic resins. Phenolic resins include those of the phenol-aldehyde type.

In one conventional general scheme, nonwoven abrasive articles have been manufactured by applying to a nonwoven web starting material a "prebond" coating of binder precursor solution, which includes one or more of the above-named resins, in order to impart sufficient strength to the nonwoven web starting material so that it can better tolerate subsequent processing. A "make" coating optionally has been applied to the prebonded nonwoven web and left non-fully cured up until the time when abrasive particles are later applied to the web to help attach the abrasive grains throughout the lofty fibrous mat. Finally, an abrasive coating of resinous binder material and abrasive particles has been applied onto the nonwoven to increase the abrasive characteristics of the nonwoven. The resin binder used in the various coatings may be the same or different.

In a conventional approach, the binder coating for the abrasive particles has been applied to the nonwoven web as a non-foamed dispersion of a binder resin and abrasive particles in a liquid medium. The dispersion is then applied to the nonwoven substrate by means, such as spraying, that either atomizes the mixture to atomized droplets, or otherwise causes a film of the dispersion to be formed on the web. The atomized droplets or film are applied to the nonwoven web and cured. During curing, the droplets either flow together (coalesce) by heat-induced viscosity reduction, or cure as individual droplets where they stand. Films usually flow together to cover (wet) most of the filaments in the nonwoven web, and they are cured in position.

As the binder resin, phenolic resins are used extensively to manufacture nonwoven abrasive articles because of their thermal properties, availability, low cost, and ease of handling. The monomers currently used in greatest volume to produce phenolic resins are phenol and formaldehyde. Other important phenolic starting materials are the alkyl-substituted phenols, including cresols, xylenols, p-tert-butylphenol, p-phenylphenol, and nonylphenol. Diphenols, e.g., resorcinol (1,3-benzenediol) and bisphenol-A (bis-A or 2,2-bis(4-hydroxyphenyl)propane), are employed in smaller quantities for applications requiring special properties.

There are two basic types of phenolic resins: resole and novolak phenolic resins. Molecular weight advancement and curing of resole phenolic resins are catalyzed by alkaline catalysts. The molar ratio of aldehyde to phenolic is greater than or equal to 1.0, typically between 1.0 and 3.0. In the production of adhesive coatings for nonwoven abrasives, one standard starting phenolic resin composition is a 70% solids condensate of a 1.96:1.0 formaldehyde:phenol mixture with 2% potassium hydroxide catalyst added based on the weight of phenol. The phenolic resin composition is typically 25–28% water and 3–5% propylene glycol ether, which are required to reduce the viscosity of the resin. In conventional techniques for making nonwoven abrasives, the phenolic resin has not been applied to the nonwoven web substrate in foamed condition.

It is possible for nonwoven abrasive articles resulting from these conventional coating methods to have an abrasive particle distribution through the thickness of the web such that abrasive particles somewhat more concentrated near the external surface regions of the mat (due to spray coating). However, substantial quantities of abrasive particles nonetheless are usually present throughout the web including the interior regions. The abrasive particles lodged in the central interior regions of the web are not immediately available for useful abrading work until the external surface (s) of the article is worn or otherwise attrited.

For applications in automotive body finishing, the ability of nonwoven abrasive articles to quickly create a uniformly scratched surface is of primary consideration. For this purpose, it would be advantageous to have the abrasive particles concentrated at the external surfaces of such nonwoven articles thereby increasing the number of such particles in immediate, simultaneous contact with the workpiece, instead of being more or less uniformly distributed throughout the thickness of the web.

The state of the art can be further understood by reference to the following references in particular:

U.S. Pat. No. 2,958,593 (Hoover et al.) describes a low density, open, nonwoven fibrous abrasive article formed of fibers formed into a nonwoven web, abrasive particles, and a curable binder. Organic fibers are adhesively bonded together at crossing and contacting points, and abrasive particles are also adhesively bonded to the web fibers. The interstices between the fibers are left open and unfilled by adhesive or abrasive particles so that the web is non-clogging and non-filling in nature, and it consequently can be readily cleaned upon flushing. The adhesive used to bond the contacting points of the fibers in the web can also be used as the means of attaching the abrasive particles to fibers in the web. The abrasive mineral particles are sprayed onto the nonwoven web as dispersed in the liquid binder solution. Alternatively, the mineral binder can be roll coated, dip coated, or separately applied relative to the abrasive particles, upon the nonwoven web. For instance, the mineral binder can be first sprayed upon the web followed by sifting of the abrasive mineral particulate upon the resin wetted web.

U.S. Pat. No. 3,175,331 (Klein) discloses a cleaning and scouring pad comprising one or more fibrous batts, heat-sealed so as to be capable of having enclosed therein a solid washing composition, and in which the outer surface of the pad has grit adhered thereto to provide a continuous, uninterrupted scouring surface extending over the entire outer surface of the pad. A fusible adhesive in liquid form is applied onto either or both surfaces of the fibrous batt sufficient to lightly impregnate the outer surface only of the batt to bond outer fibers together while not filling voids between fibers or penetrating to fibers on the opposite surface of the batt. Therefore, the amount of adhesive is regulated in order to concentrate the adhesive in the area of the surface of the batt instead of the interior of the batt. Where scouring action is desired, abrasive grit is pre-mixed into the impregnating adhesive and applied to the surface(s) of the fibrous batt, such as by spraying. Where the finished pad is to be used for washing instead of scouring, the abrasive material can be omitted from the impregnating resin used in Klein.

However, in order to limit the penetration depth of the liquid resin into the batt as in Klein, careful and time-consuming pre-consideration and monitoring during processing of many parameters, such as resin coating amount, resin flowability, resin viscosity, web thickness, web density, and so forth, would be required.

French Patent Application Publication No. 2,409,095 discloses the use of collapsible, colored foams to concentrate pigments near a surface of a porous support, such as a fibrous support. The pigments or ink base materials are incorporated into and intimately admixed with a binder in dispersion with a mechanical foam machine. A colored foam is formed in which the pigment and binder resins are temporarily suspended within a foam. The resulting colored foam is applied to a fabric surface and subjected to heat to collapse the foam such that the pigment and binder residues only penetrate the fabric surface to a limited degree. French patent 2,409,095 thus allows for surface printing or dyeing of a side or both sides of a fabric without strike-through problems. French patent 2,409,095 teaches pigments, usually relatively light and soft materials, and not dense, solid granulate, as suspended, along with the binder, within and throughout the bulk of the foam. Therefore, pigments located at the lower regions of the foam layer will contact the fabric surface immediately after, or very shortly after, the foam is applied to the fabric surface.

U.S. Pat. No. 4,969,975 (Biggs et al.) describes a process by which a homogeneous sheet comprising a uniform distribution of fibers and/or particles, which otherwise might float and/or settle, by incorporating the fibers and/or particles into a froth or foam itself, and depositing and draining the foamed dispersion on a fibrous support. As the particle additives are distributed within and throughout the foam in Biggs et al., at least a portion of such additives will immediately come into contact with the substrate used as the coating support.

As can be appreciated from the above, there still remains a need for a technique to concentrate abrasive particles in the external surface regions of a foraminous abrasive article, such as a nonwoven, by a simple manufacturing scheme that does not require extensive preparation and monitoring during processing.

SUMMARY OF THE INVENTION

The invention is generally related to a method of making a foraminous abrasive article in which abrasive particles are bonded predominantly in the surface regions of a foraminous substrate by use of a labile foamed binder as a transitory abrasive particle barrier.

For purposes of this application, "foraminous" means porous to air. Foraminous substrate materials within the scope of the invention include fibrous webs, such as nonwovens and woven materials, and non-fibrous materials, such as cured, open cell, synthetic foams and natural sponge materials.

A foraminous abrasive article formed by the inventive method is endowed with a high concentration of abrasive grains available at the surface of the substrate to deliver immediate, simultaneous polishing and/or abrading action while retaining an open, lofty, and flexible interior conducive to rinsing/flushing.

For purposes of the present invention, by "labile", it is meant that a foamed condition imparted to a liquid dispersion of binder material is susceptible to undergo physical or chemical change and that the foamed state of the binder dispersion is therefore transitory as it can be controllably eliminated. Specifically, in the context of the present invention, the labile foam binder is thermally unstable and will collapse ("fall") when heated as air and/or water is substantially evacuated from the foam in response to the heat and any concomitant curing of the resin associated with heating. By the term "foam", it is meant a dispersion of gas bubbles throughout a liquid where each bubble is enclosed within a thin film of the liquid. The gas bubbles may be of any size, from colloidal to macroscopic, with the proviso that the foam still retains sufficient cohesion to form an elastic coating film. The labile foams of the invention thus also encompass "froths", which are unstable types of foam consisting of relatively large bubbles of gas.

Briefly and in general terms, the invention uses binder dispersions applied to a foraminous substrate as a labile foam to provide a temporary support and a physical barrier between the upper surface of the substrate and abrasive particles that are subsequently deposited on the upper, exposed surface of the labile foam. The foam is then controllably collapsed by manipulation of the thermal environment of the foam-coated substrate. As heat is used to destabilize the labile foam, air and water are substantially eliminated from the foam to cause the foam to incrementally break down and "fall" until the binder resin solids and the abrasive particles gently come to rest in the surface regions of the substrate. The binder is then fully solidified or hardened, such as by heat curing a thermosetting binder resin, to attach abrasive particles to surfaces of the substrate material. The substrate material, e.g., a fibrous material, a cured foam material, a sponge material, and so forth, constitutes the support matrix or skeleton of the foraminous substrate. The present invention enables the attachment of the abrasive particles to be concentrated in the surface regions of the substrate.

Importantly, before the foam is completely collapsed, the dry abrasive particles as a matter of course are effectively pre-coated with some tacky binder resin by contact with the foam and afforded a soft landing on the surface of the substrate, such as a nonwoven web, when the foam ultimately collapses upon the actual surface of the foraminous substrate. As a consequence, the need to use large amounts of liquid resin at the substrate surface to ensure retained contact and capture of falling abrasive particles before they can deeply penetrate into the porous substrate is effectively avoided by the present invention.

In one embodiment, the method of the present invention provides a technique for manufacturing a foraminous abrasive article where abrasive particles are concentrated in an external surface region of a foraminous substrate by a scheme of steps, including:

(a) providing a foamable, hardenable, liquid resin composition and a foraminous substrate having an external surface;

(b) foaming the resin composition effective to disperse a plurality of gas bubbles throughout the resin composition;

(c) applying the foamed resin composition to the external surface of the substrate to form a foam coating layer having an upper surface;

(d) applying a plurality of abrasive particles to the upper surface of the foam coating layer;

(e) heating the foamed coating layer effective to eliminate the gas bubbles from the foamed coating layer; and (f) hardening the resin composition to attach the abrasive particles to the substrate to form a foraminous abrasive article.

In one further embodiment of the invention, the foraminous substrate is a fibrous substrate. Upon completion of this embodiment of the invention involving a fibrous substrate, preferably at least about 80%, by weight, of the abrasive particles deposited on the labile foam coating layer become attached (bonded to fibers) on or in the fibrous substrate at locations within a vertical distance measured from the coated external surface that is no greater than about 25%, more preferably no greater than about 15%, of the overall average thickness of the fibrous substrate. The vertical distance and thickness of the fibrous substrate are each measured in a direction normal to a horizontal plane defined by the external surface of the fibrous substrate. Therefore, for a nonwoven web having an overall thickness of 10 mm, at least about 80% by weight of the abrasive particles applied to the upper surface of the foamed coating layer ultimately become bonded to the web fibers located within a vertical distance of 2.5 mm from the external surface of the web that was coated with the foamed coating layer. The fibrous substrate preferably is a nonwoven web; although other fibrous substrates with porosity are also contemplated as being within the scope of the invention.

The foamed binder resin dispersion used to form the labile foam layer preferably has an air content of at least 50% by volume up to 99% by volume, a viscosity (as applied to the foraminous substrate) of at least 2,000 centipoise (at about 25° C.) , and is comprised of air bubbles having an average size of 0.1 mm. The blow ratio preferably ranges from 2:1 to 99:1, and more preferably from 15:1 to 21:1 although lower ratios are also useful as long as the foam can support the mineral.

Preferably, the composition used as the binder dispersion that is foamed to form the labile foam and coated upon the foraminous substrate is devoid of abrasive particles, in keeping with the objective of the invention of temporarily delaying contact between the foraminous substrate and abrasive particles during processing.

In the present invention, the foamed resin composition used to prepare the labile foam is a mechanical foam or a chemical foam. Preferably a mechanical foam is formed by mechanical mixing or agitation, of a gas, e.g., air, into a liquid dispersion of a binder, or alternately, the foam can be made by passing gases under pressure (e.g., injection) through a liquid dispersion of a binder.

In the present invention, an amount of gas bubble incorporation to form the foam is purposely induced at a level that will hold the abrasive particles at the surface of the foraminous substrate, by providing resin films between substrate surfaces, e.g., fibers, which support the particles. The level of foaminess is such that during the curing stage or any subsequent processing stage, the supporting foam films break down as the particles become more firmly attached to the substrate, so that finally, the films are completely broken, and the particles are attached uniformly upon and in the surface regions of the uppermost material constituting the substrate matrix.

The present invention makes it possible to concentrate abrasive particles at the surface regions of a three-dimensional, porous substrate, thus enhancing performance by allowing more particles to remain at the surface of the substrate and less particles to be embedded deeply into the substrate, where chances of exposure are limited or at least delayed during abrading/scouring. The inventive method also allows for the use of less abrasive particulate overall, due to the higher percentage of abrasive particles provided at the surface of the substrate.

In the present application, other terms, listed below, have the following meanings:

"Fibrous substrate" means a self-supporting web material constituted by contacting fibers that is porous to air.

"Nonwoven" encompasses both staple fiber webs, inclusive of random, air laid and carded webs, spun bonded and melt blown webs, and tows formed of continuous parallel-arranged filaments.

"External surface", as used in the context of a foraminous substrate herein, means an outermost, exposed major face of the substrate.

"Abrasive particle" means a solid particle capable of removing surface material from another surface when brought into inter-frictional contact therewith.

"Hardening" means solidifying a resin by drying or curing. "Curing" means cross-linking a thermosetting resin.

DETAILED DESCRIPTION OF THE PREFERRED EMBODIMENT

This invention relates to methods of making foraminous abrasive articles having high concentrations of abrasive particles bonded in the external surface regions thereof. More particularly, the invention uses binder dispersions applied to a foraminous substrate (support) in a foamed condition to provide a transitory support and barrier to immediate contact with the substrate for dry abrasive particles sequentially deposited thereon. The binder ultimately attaches the abrasive particles to surface regions of the substrate upon controlled collapse of the foam and curing of the binder material mutually contacting substrate surface areas and abrasive particles.

After the foamy coating is applied to a surface of foraminous substrate, the abrasive particles are applied in a dry fashion. The abrasive particles may be any of type, shape, material, or size as long as the surface of the substrate material, e.g. fibers, and the gross surface of the particles are influenced by the surface tension effects of the coating. However, all or substantially all of the abrasive particles should be at least partly visible as resting on the top surface of the foam barrier up until the time the foam is destabilized by heat and time or pressure. Further, no significant fraction, i.e., >0.001% by wt., of the abrasive particles should completely sink into or become fully submerged into the bulk of the foam barrier layer until the foam collapses to about 5% of its original thickness.

Curing steps are introduced to cure the coating and attach the particles permanently to the substrate. As curing commences, the changes in the coating due to heat cause the films of the foam to break down and fall (collapse), leaving the abrasive mineral deposited on the surface of the substrate fibers or other support matrix material. Subsequent curing time gives more film breakage until the foam coating layers or films are completely reduced as the particles and binder harden in their positions.

While the foraminous substrate is occasionally exemplified herein as a nonwoven web, for sake of illustration, it is to be understood that the substrate material is not limited thereto. For example, other forms of foraminous fibrous materials e.g., woven cloths, nonwoven batts, directional webs, and the like, are also useful substrate materials for processing by the invention. Moreover, non-fibrous foraminous substrates also can be employed, such as cured, open celled synthetic foams and natural sponge materials.

Nonwoven Webs

While the fibrous substrate of the invention can alternately be a woven cloth, or a directional web, a preferred fibrous substrate is a nonwoven web. In this regard, web formation equipment suitable for the practice of this invention include any such equipment capable of forming a nonwoven fabric from the fibers described above. Cards, garnetts, wet-lay, and air-lay equipment may be used. Air-lay is preferred. Appropriate air-lay equipment include that known commercially as "Rando Webber", that known commercially as "Dr. O. Angleitner" or "DOA", or a hybrid system known as a "Hergeth" randomizing card. The operating parameters for such equipment are well known to those normally skilled in the art. Nonwoven fabrics prepared using apparatus such as these have at least two major external surfaces.

In a preferred embodiment, the fibrous substrate is an open, lofty, three-dimensional air-laid nonwoven fabric, and can be made with nonwoven webs and fiber adhesive treatments (except with no abrasive slurry treatment) such as those described in U.S. Pat. No. 2,958,593 (Hoover et al.), which is incorporated herein by reference. Also preferred are spunbonded, continuous filament nonwoven web constructions such those as described by Fitzer in U.S. Pat. No. 4,227,350, which is also incorporated herein by reference.

As an optional enhancement to a nonwoven abrasive article made according to the invention, it is often desirable to promote fiber bonding within the nonwoven article, e.g., a nonwoven web, so that the article will have greater structural strength and durability to better tolerate abrasive removal and cleaning environments. Conventional fiber adhesives that are devoid of abrasive components which are used to further consolidate nonwoven webs can be used for this procedure. Such a fiber treatment can be imparted to the web as a separate treatment prior to or after the abrasive particles are adhesively attached to external surface areas of the nonwoven substrate. The fiber adhesive treatment can be applied dry, as in the form of conventional thermal-bonding short fibers, or in liquid form using known coating or spraying techniques followed by hardening and/or curing of the fiber treating or coating materials in place. Embrittlement or filling of the nonwoven article by the fiber treatment is to be avoided. Liquid form fiber treating materials that do not contain abrasive grit that can be used in this regard include those described in U.S. Pat. No. 2,958,593 (Hoover et al.), which is incorporated herein by reference.

Preferably, the fibers are bonded together at only their points of crossing contact. This helps to provide an open, low density, lofty web where the interstices between fibers are left substantially unfilled by resin or abrasive. For cleaning and scouring type applications, the void volume of the finished nonwoven abrasive article preferably is in the range of about 75% to about 95%. At lower void volumes, a nonwoven article has a greater tendency to clog-up which reduces the abrasive cutting rate and hinders cleaning of the web by flushing. If the void volume is too high, the web may lack adequate structure to withstand the physical stresses associated with cleaning or scouring operations without rapidly failing.

The nonwoven abrasive article is provided as either a continuous web, or it can be discrete web. In making production quantities, use of a continuous nonwoven will usually be more practical. If desired, the nonwoven article can be treated with a fiber adhesive.

Fibers

Fibers suitable for use in the fibrous substrates of the present invention are not particularly limited. A wide variety of fibers are useful in a fibrous web, e.g., a nonwoven web, used as the fibrous substrate, including both natural and synthetic fibers, and mixtures thereof. Synthetic fibers are preferred. Synthetic fibers include those made of polyester (e.g., polyethylene terephthalate), nylon (e.g., hexamethylene adipamide, polycaprolactum), polypropylene, acrylic (formed from a polymer of acrylonitrile), rayon, cellulose acetate, polyvinylidene chloride-vinyl chloride copolymers, vinyl chloride-acrylonitrile copolymers, and so forth. Natural fibers include those of cotton, wool, jute, and hemp.

The fiber used may be virgin fibers or waste fibers reclaimed from garment cuttings, carpet manufacturing, fiber manufacturing, or textile processing, and so forth. The fiber material can be a homogenous fiber or a composite fiber, such as bicomponent fiber (e.g., a co-spun sheath-core fiber). Fibers may be conventionally spun or may be formed by known spunbonding or melt blowing methods, whereby the fibrous substrate is formed as the fibers are formed.

The denier of the fiber used may vary widely, depending upon the results desired. For example, heavier denier is more conducive to making coarse pads for rough scouring jobs, while lighter denier is more appropriate for finer, less aggressive scouring jobs. The thickness of the fibers is not particularly limited (apart from processing considerations), as long as due regard is given to the resilience and toughness ultimately desired in the resulting web. With the "Rando-Webber" equipment, fiber thicknesses are generally within a range of about 25 to about 250 microns, corresponding to a fiber fineness or linear density of between about 5 and about 500 denier.

The fibers can be curled, crimped and/or straight. However, in the interest of obtaining maximum loft, openness and three-dimensionality in the nonwoven article web it is preferable that all or a substantial amount of the fibers be crimped. However, crimping is unnecessary where fibers are employed which themselves readily interlace with one another to form and retain a highly open lofty relationship in the formed web.

By way of example, polyamide staple fibers of tenacity between 1.0 and 10.0 g/denier can be used. Fibers of a lower tenacity are too fragile to process through web forming machines. Fibers of tenacity higher than 10.0 g/denier are expensive and are difficult to impart stable crimp. While any polyamide can be successfully incorporated into the fibrous substrates of this invention, nylon 6 and nylon 6,6 are preferred. Nylon 6,6 is most preferred. The staple length of the fibers of this invention may be from about 0.75 inches to 6 inches, preferably 1.0 inches to 4.0 inches, most preferably 1.5 inches to 3 inches. The appropriate crimp level (as measured full-cycle) can be between about 4 crimps/inch and about 20 crimps/inch, preferably from about 8 crimps/inch to about 16 crimps/inch. Especially useful staple fiber for the practice of the present invention is a 15 denier staple fiber of nylon 6,6 cut to a 1.5 inch staple length, commercially available under the trade designation "Type 852" from E.I. DuPont de Nemours, Wilmington, Del.

The fibers can be used in the form of a cloth, web, a batt, or a tow. As used herein, a "batt" is meant to refer to a plurality of webs, or similar structures made by air-lay methods.

Binder Dispersion

The binder composition used must be capable of being foamed. The binder composition can be an aqueous dispersion of a binder that hardens upon drying, such as an acrylic resin emulsion, or a dispersion of a thermosetting (curing) binder. Thermosetting resins are preferred, such as binder resins selected from among phenol formaldehyde resins, phenoplasts, aminoplasts, unsaturated polyester resins, vinyl ester resins, alkyd resins, allyl resins, furan resins, epoxies, polyurethanes, and polyimides. For example, phenolic resins suitable for the present invention include both resole and novolak phenolic resins. Preferred is a resole-type phenolic resin comprising phenol and an aldehyde, for example, a 2:1 formaldehyde:phenol composition with a NaOH catalyst.

More preferred foamable, coatable, hardenable resin compositions are resole phenolic resins comprising a surface active agent which assists in the formation of and enhances the stability of the resultant foam. An exemplary surface active agent is Minnesota Mining and Manufacturing Company FLUORAD FC-170 fluorochemical surfactant, which can be obtained from the Minnesota Mining and Manufacturing Company of St. Paul, Minn.

Foaming agents (emulsifiers) or surfactants are added to the binding resin dispersion and applied to the foraminous substrate, e.g. a nonwoven web, using coating methods that are compatible with liquid coatings. The level of surfactant or foaming agent is usually much larger than normally recommended for general surface tension modification. Amounts nearing 1.0% to 2.0% of total wet components have been used, compared to 0.1% recommended levels for general surface tension modifications of coatings. By corollary, the binder dispersion of the present invention should be devoid of anti-foaming agents.

Foamable, Coatable, Hardenable Resin Composition

Foamable, coatable, hardenable resin compositions useful in the practice of the present invention may be any that can be caused to retain its foam form for a sufficient length of time to allow the application of the abrasive particles. The resin compositions may be foamed by known methods, including mechanically foaming or frothing, the injection and dispersion of insoluble gas, or by the use of chemical blowing agents that thermally or otherwise decompose to produce a gas-phase material. Mechanical agitation is used to advantage to incorporate air into a liquid resin system (latex): such processes are sometimes referred to as "aeration" or "frothing".

For the purposes of the present invention, the foamable, coatable, hardenable resin compositions should be foamable to a blow ratio, i.e., the ratio of foamed volume to that of the unfoamed starting material, of between 2:1 and 99:1.

Upon completion of the inventive method, preferably, at least about 80%, by weight, and more preferably between 80% and 90%, by weight, of abrasive particles deposited on the foam coating layer become attached (bonded to fibers) on or in the fibrous substrate at locations within a vertical distance measured from the coated external surface that is no greater than about 25%, and more preferably no greater than about 15%, of the overall average thickness of the fibrous substrate. The vertical distance and thickness of the fibrous substrate are each measured in a direction normal to a horizontal plane defined by the external surface of the fibrous substrate. Therefore, for a nonwoven web having an overall thickness of 10 mm, at least about 80%, by weight, of the abrasive particles applied to the upper surface of the foamed coating layer ultimately become bonded to the web fibers located within a vertical distance of 2.5 mm from the external surface of the web that was coated with the foamed coating layer.

The foamed binder resin dispersion preferably has an air content of at least 50% by volume up to 99% (or a blow ratio of between 2:1 and 99:1, more preferably between 15:1 and 21:1), a viscosity (as applied to the nonwoven web) of at least 2,000 centipoise, and is comprised of air bubbles having an average size of 0.1 mm.

The labile foam must retain its structural integrity at least until the abrasive particles are added to the composite. Otherwise, the abrasive particles would not have the temporary foam support that allows for the abrasive particles to be concentrated at the external surfaces of the substrate, such as a nonwoven web, after the temporary foam barrier collapses ("falls") when heated, e.g., in a drying oven, during curing of the resin as water and entrapped air is substantially eliminated from the foam.

After applying the abrasive particles to a surface of the froth or foam coating layer on the substrate, the substrate is exposed to a heat source, such as infrared lamps, to heat the substrate, froth to an extent necessary to collapse the foam. Heating can be done with any source giving sufficient heat distribution and air flow. Infrared lamps are useful for applying heat in this manner.

In the case of heat-activatable thermosetting resin foams, it is preferred that heating is sufficient to initiate curing (cross-linking) of the resin, which will cause solidification of the resin and mutual adhesion of contacted abrasive material and substrate matrix surfaces.

Preferably, the substrate, e.g., a nonwoven web, is then inverted and the opposite surface of the substrate is coated with the foam and abrasive particles and heat-treated in the same way as the first surface.

Abrasive Particles

Suitable abrasive particles include those of any appropriately hard material such as flint, talc, garnet, aluminum oxide, silicon carbide, diamond, silica, and a alpha-alumina ceramic material available commercially under the trade designation "CUBITRON" from the Minnesota Mining and Manufacturing Company of St. Paul, Minn. Abrasive particle sizes may be any but are typically from 1 micrometer or less to one millimeter or more in dimension. Alternatively, suitable abrasive particles need not be inorganic materials, but may rather be synthetic materials such as poly(methyl methacrylate), polycarbonate, poly(vinyl chloride), or other organic thermosetting or thermoplastic material suitably reduced to an appropriate particle size. The hardness, composition, and size of the abrasive particles are readily selectable by one of normal skill in the art, taking into consideration the nature of the workpiece to be abraded.

The abrasive particles can be drop coated, sprinkled, sprayed, and the like, in a dry condition upon the upper surface of the foam coating layer, such as by conveying the substrate beneath a particle dispenser.

Suitable Converted Forms

Foraminous abrasive articles made by the present invention may take any of a variety of conventional converted forms such as sheets, blocks, strips, belts, brushes, rotary flaps, discs, or solid or foamed wheels. Especially useful forms are discs, sheets, and wheels. The wheels are typically in the form of a right circular cylinder having dimensions which may be very small, e.g., a cylinder height on the order of a few millimeters, or very large, e.g., two meters or more, and a diameter which may be very small, e.g. on the order of a few centimeter, or very large, e.g., one meter or more. The wheels typically have a central opening for support by an appropriate arbor or other mechanical holding means to enable the wheel to be rotated in use. Wheel dimensions, configurations, means of support, and means of rotation are well known in the art.

Abrasive articles of larger dimensions may be made by the preparation of multi-layer "slabs" or "buns". Uncured or partially cured layers of nonwoven abrasive sheet materials may be stacked, compressed and fully cured to make a layered composite structure capable of being converted into useful articles of substantial dimensions. This layered composite may be used as the source of a multitude of articles of the invention, each having various diameters, or all having the same diameter, as required by the uses. Articles of the invention may be produced from the layered composites by machining using appropriate techniques which are also well known in the art. For example, a wheel shape may be die cut from a slab of the layered composite. Additionally, ribbons, strips, or elongate segments of a nonwoven abrasive sheet may be spirally (convolutely) wound into a wheel shape while the binder is uncured or partially cured and then fully cured to yield a wheel.

The foraminous abrasive articles made according to this invention can be used as a cleaning, or material removing tool, or as a primary component of such a tool.

In the following examples, objects, features and advantages of this invention are further illustrated by various embodiments thereof but the details of those examples should not be construed as limiting the invention. All parts and percentages are by weight unless indicated otherwise.

EXAMPLES

Example 1

A low-density non-woven web weighing 147 g/m$^2$ was formed from 1.5-inch staple of 12 denier nylon 6,6 fibers of tenacity 8.2 g/denier (commercially available under the trade designation "Type 885" from E.I. DuPont de Nemours, Wilmington, Del.) on a web-forming machine available under the trade designation "Rando Webber", Rando Machine Co., Macedon, N.Y. A 109 g/m$^2$ (cured weight) phenolic resin prebond coating was applied to the web via a two-roll coater and cured at 175° C. for about 2 minutes. The resulting prebond web was then coated with a resin composition consisting of 57.0% phenolic resin, 42.3% water, and 1.7% surfactant ("3M Fluorad FC-170" fluorochemical surfactant available from Minnesota Mining and Manufacturing Company, St. Paul, Minn.) that was frothed to a labile foam form by mechanical infusion of air into the resin. The froth was formed by blending air into the liquid resin by using a set of high speed pins (blades) in a blending chamber in equipment obtained from CSKG Industries, Inc. Reading, Penn. (also available from Gaston County Fabrication, Stanley, N.C.). The labile foam formed was applied to the exposed face of the nonwoven web via a two-roll coater operating at about 1.4 m/min and a nip load of 31–36 kg/cm of roll width, resulting in a 209–315 g/m$^2$ wet add-on (cured coating weight of 83–126 g/m$^2$).

Following application of the foam coating, the upper surface of the foam coating on the web was coated with 104 to 126 g/m$^2$ ANSI grade 280 & finer, dry alumina abrasive particles by the use of venturi outlets positioned 5 to 8 cm above the froth-containing nonwoven web. The mineral dropping apparatus was fed by venturi powder pumps which were fed from a fluidized bed. The fluidized bed was a metal box with a sealed lid and powder pumps pulling fluidized mineral and air out of the top. The powder pumps received air at 0.7 to 1.4 kg/cm$^2$ (10 to 20 psi) from a source external to the box as the means to convey the powder pulled from the fluidized bed to the ventura outlets (guns). The floor of the box was a membrane that allowed air to pass through from another chamber below. This lower chamber was fed with compressed air from 2.8 to 5.6 kg/cm$^2$ (40 to 80 psi), depending on the mineral particle size and density.

The resulting web was then inverted and an identical foam coating and a particle coating was applied to the opposite side of the web in the same manner as the first coated side. The abrasive-coated foam/web composite was then directed through an oven set at 175° C. providing a residence time of 3 to 4 minutes to break the foam and cure the binder. The resulting article was free of foamed binder and was well bonded.

The process of this example resulted in about 80%, by wt., of the abrasive particles on each web face being deposited within a depth from the respective exterior surfaces of the web that is equal to no more than 25% of the thickness of the web with the innermost portion of the web being essentially free of abrasive particles. The example also showed increased coating efficiency since few particles passed completely through the web (which results in waste) due to the labile foam's presence.

While the invention has been described in terms of its preferred embodiments, those skilled in the art will recognize that the invention can be practiced with modification within the spirit and scope of the appended claims.

What is claimed is:

1. A method for making a foraminous abrasive article, comprising the steps of:

(a) providing a foamable, hardenable, liquid resin composition and a foraminous substrate having an external surface;

(b) foaming said resin composition to effectively disperse a plurality of gas bubbles throughout said resin composition to provide a labile foamed resin composition;

(c) applying said labile foamed resin composition to said external surface of said substrate to form a labile foam coating layer having an exposed surface;

(d) applying a plurality of abrasive particles to said exposed surface of said labile foam coating layer;

(e) heating said foamed coating layer to effectively eliminate said gas bubbles from said labile foamed coating layer and provide a resin coating including said abrasive particles; and (f) hardening said resin coating to attach said abrasive particles to said substrate to form a foraminous abrasive article.

2. The method of claim 1, wherein said foraminous substrate comprises a porous material selected from the group consisting of synthetic foam material and natural sponge material.

3. A method for making a fibrous abrasive article comprising the steps of:

(a) providing a foamable, hardenable, liquid resin composition and a fibrous substrate having an external surface;

(b) foaming said resin composition to effectively disperse a plurality of gas bubbles throughout said resin composition to provide a labile foamed resin composition;

(c) applying said foamed resin composition to said external surface of said fibrous substrate to form a labile foam coating layer having an exposed surface;

(d) applying a plurality of abrasive particles to said exposed surface of said labile foam coating layer;

(e) heating said foamed coating layer to effectively eliminate said gas bubbles from said labile foam coating layer; and provide a resin coating including said abrasive particles and (f) hardening said coating composition to attach said abrasive particles to said fibrous substrate to form a fibrous abrasive article.

4. The method of claim 3, wherein at least about 80%, by weight, of said abrasive particles applied to said foamed coating layer in step (d) become attached to said fibrous substrate upon completion of step (f) within a vertical distance measured from said external surface that is no greater than about 25% of overall average thickness of said fibrous substrate.

5. The method of claim 3, wherein said foamed resin composition has an air content of at least 50% by volume up to 99% by volume upon completion of step (b).

6. The method of claim 3, wherein said foamed resin composition has a blow ratio of between 15:1 to 21:1 upon completion of step (b).

7. The method of claim 3, wherein said gas bubbles comprise air bubbles.

8. The method of claim 3, wherein said gas bubbles have an average size of 0.1 mm.

9. The method of claim 3, wherein said foamed resin composition is devoid of abrasive particles.

10. The method of claim 3, wherein said fibrous substrate comprises a nonwoven substrate.

11. The method of claim 10, wherein said nonwoven substrate is selected from the group consisting of a nonwoven web, a nonwoven batt, and a nonwoven tow.

12. The method of claim 3 wherein said fibrous substrate comprises organic fibers selected from the group consisting of natural fibers, synthetic fibers, and mixtures thereof.

13. The method of claim 3, wherein said fibrous substrate comprises organic fibers selected from the group consisting of polyester, polyamide, polypropylene, acrylic, rayon, cellulose acetate, polyvinylidene chloride-vinyl chloride copolymer, vinyl chloride-acrylonitrile copolymer, and mixtures thereof.

14. The method of claim 3, wherein said foaming of step (b) comprises mechanical foaming.

15. The method of claim 3, wherein said foaming of step (b) comprises mechanical agitation of said resin composition.

16. The method of claim 3, wherein said foaming of step (b) comprises injection of gas through said resin composition.

17. The method of claim 3, wherein said resin composition comprises a binder resin selected from the group consisting of phenol formaldehyde resins, phenoplasts, aminoplasts, unsaturated polyester resins, vinyl ester resins, alkyd resins, allyl resins, furan resins, epoxies, polyurethanes, and polyimides.

18. The method as in claim 3, wherein said abrasive particles are selected from the group consisting of aluminum oxide, coal slag, flint, silicon carbide, garnet, silica, talc, glass, metal particles, and granite.

* * * * *